United States Patent [19]

Smith, Jr. et al.

[11] 4,165,997

[45] Aug. 28, 1979

[54] INTERMEDIATE TEMPERATURE SERVICE ALLOY

[75] Inventors: Darrell F. Smith, Jr.; Edward F. Clatworthy, both of Huntington, W. Va.

[73] Assignee: Huntington Alloys, Inc., Huntington, W. Va.

[21] Appl. No.: 845,474

[22] Filed: Oct. 26, 1977

Related U.S. Application Data

[63] Continuation-in-part of Ser. No. 780,608, Mar. 24, 1977, abandoned.

[51] Int. Cl.[2] ..... C22C 38/48; C22C 38/50

[52] U.S. Cl. ..... 148/38; 75/122; 75/124; 75/128 F; 75/128 G; 75/128 T

[58] Field of Search ..... 75/122, 128 T, 128 G, 75/128 F, 124; 148/38

[56] References Cited

U.S. PATENT DOCUMENTS

| | | | |
|---|---|---|---|
| 3,065,067 | 11/1962 | Aggen | 75/128 T |
| 3,212,884 | 10/1965 | Soler et al. | 75/128 T |
| 3,243,287 | 3/1966 | Lillys et al. | 75/128 G |
| 3,300,347 | 1/1967 | Kasza et al. | 75/128 T |
| 3,663,213 | 5/1972 | Eiselstein et al. | 75/128 T |
| 3,705,827 | 12/1972 | Muzyka et al. | 75/128 T |
| 3,935,037 | 1/1976 | Muzyka et al. | 75/128 T |
| 4,066,447 | 1/1978 | Smith, Jr. et al. | 75/128 T |

FOREIGN PATENT DOCUMENTS

| | | | |
|---|---|---|---|
| 656085 | 1/1963 | Canada | 75/128 T |
| 999439 | 7/1965 | United Kingdom | 75/128 T |

*Primary Examiner*—Arthur J. Steiner

*Attorney, Agent, or Firm*—R. J. Kenny; E. C. MacQueen

[57] ABSTRACT

Iron-nickel-chromium alloy wherein other elements, including columbium and titanium, are specially controlled has high strength and long-time stability for extended service at intermediate temperatures, such as automotive turbine service for 5000 hours at 1200° F.

8 Claims, No Drawings

INTERMEDIATE TEMPERATURE SERVICE ALLOY

This application is a continuation-in-part of our U.S. application Ser. No. 780,608, filed Mar. 24, 1977 now abandoned.

The present invention relates to heat-resistant alloys and more particularly to heat-resistant iron-nickel-chromium alloys.

It is well known that gas turbines and other heat-powered engines require alloys having heat-resistant characteristics such as retention of strength and ductility, and resistance to oxidation and other corrosion at engine operating temperatures. While nickel-based alloys often serve special needs of the more severely heated and stressed components in aircraft turbines, it is economically desirable, particularly from the viewpoint of cost, to provide iron-based alloys for automotive turbines, and also for intermediate-temperature utility in aircraft and other structures. Cost problems involve metal costs of raw materials for the alloy, production costs of machining and other fabricating of the alloy to form components, e.g., compressor blades and seal rings, and operational life before replacement is required. For the automotive field, operational endurance of frequent heating to the intermediate temperature area of around 1100° F. to 1300° F. is especially important and it is also important to have high strength, such as yield strength above 100,000 pounds per square-inch and retention of strength and ductility, and other metallurgical stability, for prolonged periods of time such as 5000 or 10,000 hours. And, of course, resistance to oxidation and other hot corrosion are also requisite for heat resistance.

Although some progress has been made heretofore, there are outstanding needs for new alloys, products and articles to provide desirably high strength and endurance at desirably low cost.

There has now been discovered an alloy based on iron with nickel, chromium, columbium and titanium in special proportions that provide stable long-enduring heat-resistant properties for service in gas turbines and other machines and structures needed for achieving long-life elevated temperature service with commercially economical apparatus.

It is an object of the invention to provide a heat-resistant alloy.

Another object is to provide heat-resistant wrought products and articles, such as plate, sheet, strip, rod, tubing and forgings.

Other objects and advantages will become apparent from the following description.

The present invention contemplates a heat and corrosion resistant alloy, and products thereof, having a composition comprising, by weight, 29% to about 34% nickel, 10% to 14% chromium, percentages of titanium and columbium in ranges of 1.5% to 2.5% titanium and 0.95% to 2.15% columbium and correlated according to the compositional relationship (Rel.A) whereby the percentage sum of the titanium content plus one-third the columbium content is at least 2%, advantageously 2.5% or higher, 0.002% to 0.015% boron, up to about 2% manganese, up to 0.5% silicon, up to 0.8% aluminum, up to 0.1% carbon and balance essentially iron in an amount of about 45% or more of the alloy. The alloy composition is desirably maintained devoid of molybdenum and tungsten insofar as is practicable, e.g., 0.8% or less in total, and in no event exceeds 0.5% molybdenum or 0.5% tungsten individually, more desirably not more than 0.3% molybdenum and not more than 0.3% tungsten.

Tantalum may be present in minor small amounts such as are often associated with columbium obtained from commercial sources, e.g., tantalum amounts up to about 1% of the amount of columbium present; or, larger amounts may take the place of columbium on a parts-by-weight basis of a double part tantalum in place of one part columbium. Thus, the alloy can be referred to as having 0.95% to 2.15% metal from the group columbium plus ½ tantalum, and a sum of % Ti+⅓(%Cb+½%Ta) totaling at least 2%, advantageously 2.5% or more.

Minor amounts of tolerable impurities and incidental elements that may be present along with the balance of essentially iron include possible presence of up to about 0.015% sulphur, and 0.015% phosphorus, up to 0.02% each zirconium, calcium and magnesium and up to about 1% copper.

Advantageous controls to benefit strength and ductility characteristics include control of titanium, columbium or boron, individually or in combination, to ranges of 1.8% to 2.5% titanium, 1.25% to 2.1% columbium and 0.002% to 0.010% boron, and restriction of carbon or aluminum to percentages not exceeding 0.06% and 0.40%, respectively. Presence of aluminum in small amounts such as 0.02% or more is deemed beneficial to ductility of products made of the alloy.

For special assurance of long-time stability, it is desirable to restrict the sum of the titanium-plus-columbium content, or %Ti+%Cb+½(%Ta), to not exceed 4.4%.

The composition is age-hardenable and enables providing age-hardened alloys having good metallurgical stability that retains strength and ductility throughout a wide range of temperatures extending from low subzero temperatures, such as cryogenic temperatures of minus 320° F., up to elevated temperatures in the area of 1100° F. to 1200° F. (sometimes referred to as being intermediate elevated temperatures or as being in the low-ductility trough, in relation to high elevated temperatures like 1800° F.). Generally, forgings of the alloy are annealed for at least partial solution and recrystallization treatment prior to age hardening.

Heat treatments for annealing of the alloy can be at about 1650° F. or higher for about 0.25 hour or longer according to thickness, e.g., 1700° F. to 1950° F. for periods of 0.25 hour up to 1 hour. Inasmuch as annealing affects grain size and properites, annealing temperature is advantageously restricted to about 1800° F. for obtaining fine grain structures of ASTM-6.5 or finer to benefit tensile strength and rupture ductility, or can be at a higher temperature, e.g., 1900° F., to provide coarser grain structures such as ASTM-5.5 or larger and benefit stress-rupture strength. Also, the higher anneal can be applied for furthering solution and recrystallization. If desired, an 1850° F. anneal can be used for obtaining specially desired combinations of characteristics.

Good temperatures for age hardening the present alloy are in the temperature area of from 1350° F. to about 1100° F. A duplex aging treatment starting with heating the annealed alloy for 8 hours at 1350° F. or 1325° F., continuing by furnace cooling to 1150° F. at a cooling rate of 100° F. per hour, holding 8 hours at 1150° F., and finally air cooling to room temperature has provided satisfactory age-hardening of the various embodiments of the alloy.

Where desired, the alloy can be treated with a triple heat treatment whereby, intermediately between annealing and aging, the alloy is heated at 1400° F. to 1600° F., e.g., 1550° F. for about one hour, possibly ½ hour to 6 hours, and air cooled to room temperature, or to the starting aging temperature, e.g., 1325° F. The triple treatment may be desirable for improved rupture ductility and notch rupture strength.

Generally, the grain size of the alloy structure remains practically the same throughout the aging and intermediate heat treatments.

Microstructure of the wrought alloy in the age-hardened condition has a soft ductile matrix, room temperature hardness typically about $R_b$75, and, distributed uniformly therein, a gamma prime phase ($A_3B$) of sub-optical size.

Satisfactory strength and ductility characteristics of products of the alloy in the aged-hardened condition include room temperature yield strength of 110,000 psi or higher, room temperature Charpy V-Notch impact strength of at least 25 foot-pounds, and 1200° F.-strength and ductility sufficient for 23 hours life and 3% stress-rupture elongation when tensile loaded to 75,000 psi at 1200° F. in a 3.5 $K_t$ notch/smooth bar configuration. Stability characteristics are evidenced by, among other things, CVN impact energy of 10 ft.-lb. or more at room temperature after being exposed 1000 hours at 1200° F. (In the absence of CVN data, satisfactory stability may be indicated by 25% or more reduction of area in a room temperature tensile test after long-time elevated temperature exposure).

In carrying the invention into practice, the composition is advantageously controlled to comprise 29% to about 33% or 34% nickel, 10% to 14% chromium, 1.8% to 2.5% titanium and 1.25% to 2.1% columbium in proportions providing a sum of %Ti+⅓%Cb equaling at least 2.5%, 0.002% to 0.010% boron, up to 2% manganese, up to 0.4% aluminum, up to 0.35% silicon, up to 0.06% carbon and balance essentially iron with any presence of molybdenum and tungsten restricted to avoid exceeding a total of 0.6% molybdenum-plus-tungsten, to achieve advantageously good characteristics of 125,000 psi or more yield strength at room temperature and stress-rupture strength for 23 hours or more life with 95,000 psi load at 1200° F. and at least 5% elongation at rupture in combination with notch-ductility.

For purposes of giving those skilled in the art a further understanding of the practice and advantages of the invention, the following examples are given.

EXAMPLE I

An alloy referred to herein as alloy 1 was made to a nominal composition of 31% nickel, 12% chromium, 2.5% titanium, 1.5% columbium, 0.02% carbon, 0.9% manganese, 0.005% boron and balance iron by vacuum induction melting elemental metals and ferroalloys, e.g., electrolytic nickel or nickel pellets, and ferrocolumbium, and then casting and solidifying the melt in an ingot mold. Results of chemical analysis of alloy 1 are set forth in the following Table I. The ingot was soaked about 12–16 hours at 2050° F. for homogenization are forged to 2¼" square billets, and a portion further forged to a square bar size of about 9/16"–⅝". Forging preheat and reheat temperatures were 2050° F. Forgeability characteristics were very good. Results of testing heat-treated specimens taken from billet and bar stock confirmed that the alloy was highly satisfactory for providing good mechanical properties at room temperature and at elevated temperatures. For instance, with forged bar of this example, yield strength in the annealed plus aged condition substantially exceeded 140,000 psi (pounds per square inch) at room temperature and also exceeded 120,000 psi at 1200° F. And, to confirm reasonably good anisotropy of characteristics, subsize specimens (0.715" gage length, 0.178" gage diameter) were taken transversely (referred to by No. 1-T) from 2¼-inch billet stock and tested. Additionally, to confirm good long-time stability when exposed to elevated temperatures for extended periods of time, bar stock specimens which had been annealed and aged were held at elevated temperatures for exposure times up to 12,000 hrs. and thereafter tensile and/or impact tested. Results of testing heat treated wrought products of alloy 1 for yield strength at 0.2% offset (YS), ultimate tensile strength (UTS), percent elongation (El) and reduction of area (RA) after fracture, Charpy V-notch (CVN) impact "strength," or absorbed energy, and for stress-rupture strength and for both smooth-section and notch-section ductility characteristics, set forth in the following Tables II and III, show satisfactory characteristics obtained with alloy 1.

EXAMPLE II

Wrought bar stock of alloy 2 was prepared by air induction melting to a nominal composition of 31% nickel, 12% chromium, 2174 % titanium, 1% columbium 0.02% carbon, 1% manganese, 0.005% boron and balance iron, casting an ingot and then forging to 9/16" square bar. Ingot homogenization temperature was 2100° F.; forging preheat was 2000° F. Results of chemical analyses and mechanical property testing are set forth in Tables I, II and III and confirm success in obtaining advantageously good characteristics.

EXAMPLES III to VII

In other examples, wrought products of alloys 3 and 5 were prepared by air melting, and of alloys 4, 6 and 7 by vacuum melting, forging to 2¼-inch billets and ⅝-inch or 9/16-inch bars by practices generally along the lines of Examples I and II. Results of chemical analysis and mechanical testing set forth in Tables I, II and III show satisfactory, and better, characteristics obtained in a wide range of temperatures from minus 320° F. to 1300° F. Some changes in annealing and aging demonstrated that the alloy composition is suitable for some variety of annealing and aging treatments. For instance, aging of alloy 5 started at 1325° F.; thus, the alloy, after annealing ½ hour at 1800° F., was reheated and treated with a duplex age by maintaining the alloy 8 hours at 1325° F., furnace cooling to 1150° F. at a rate of 100° F. per hour, holding 8 hours at 1150° F., followed by air cooling. For stress-rupture tests of alloy 4, some specimens were annealed at 1800° F. and others annealed at 1900° F. Alloy 6 had a triple treatment whereby the alloy was annealed at 1800° F., reheated for an intermediate treatment of 3 hours at 1550° F., air cooled, then duplex aged starting at 1325° F.

Optical metallographic studies of specimens from the foregoing examples showed relatively fine grain material with some fine spherical intragranular carbides and clean regular grain boundaries with no apparent undesired phases (e.g., eta, delta, sigma, Laves). The hardening phase was too small to resolve at optical magnifications (up to 1000×).

TABLE I

| Alloy No. | Chemical Analysis (Weight Percent) Ni | Cr | Ti | Cb | Al | C | Mn | Si | B | S | Fe | Relationships A | B |
|---|---|---|---|---|---|---|---|---|---|---|---|---|---|
| 1 | 33.98 | 12.51 | 2.23 | 1.50 | 0.28 | 0.007 | 0.88 | 0.23 | 0.003 | 0.005 | Bal. | 2.73 | 3.73 |
| 2 | 31.21 | 12.45 | 2.38 | 0.99 | 0.23 | 0.01 | 0.98 | 0.23 | 0.005 | 0.004 | Bal. | 2.71 | 3.37 |
| 3 | 31.23 | 12.51 | 2.34 | 1.49 | 0.18 | 0.01 | 1.00 | 0.24 | 0.005 | 0.003 | Bal. | 2.84 | 3.83 |
| 4 | 31.34 | 11.90 | 2.16 | 1.58 | 0.19 | 0.01 | 0.86 | 0.24 | 0.005 | 0.005 | Bal. | 2.69 | 3.74 |
| 5 | 31.65 | 12.12 | 2.22 | 2.12 | 0.18 | 0.02 | 1.06 | 0.25 | 0.003 | 0.007 | Bal. | 2.92 | 4.36 |
| 6 | 31.27 | 12.03 | 2.34 | 2.03 | 0.19 | 0.05 | 0.80 | 0.14 | 0.005 | 0.008 | Bal. | 3.02 | 4.37 |
| 7 | 32.04 | 11.50 | 1.68 | 1.32 | 0.14 | 0.04 | 0.79 | 0.18 | 0.006 | 0.008 | Bal. | 2.12 | 3.00 |

Bal. = Balance (may include up to 0.05% copper)
Columbium analyses may include tantalum in amounts up to 1% of columbium analysis
A = (%Ti)+⅓(%Cb)
B = (%Ti)+(%Cb)

TABLE II (S-1 of 3)

| Alloy No. | Heat Treatment | Exposure Time | Test Temp. ° F. | YS ksi | UTS ksi | El % | RA % | CVN Ft - lbs. |
|---|---|---|---|---|---|---|---|---|
| 1 | Ann | — | RT | 40 | 102 | 47 | 65 | — |
| | Ann+Age | — | " | 145 | 198 | 20 | 40.5 | 51 |
| | " | — | 1200 | 127 | 147 | 24.5 | 42 | — |
| | Ann+Age+ | 1000hrs. at 1000° F./A.C. | RT | 148 | 197 | 23 | 50 | 43 |
| | " | 5000hrs. at 1000° F./A.C. | " | 154 | 200 | 22 | 44 | 46 |
| | " | 12000hrs. at 1000° F./A.c. | " | — | — | — | — | 43 |
| | " | 1000hrs. at 1200° F./A.C. | " | 149 | 196 | 18 | 34 | 32 |
| | " | 5000hrs. at 1200° F./A.C. | " | 140.5 | 187 | 16 | 27 | 18 |
| 1-T | Ann | (Center) | RT | 39.2 | 95.2 | 58* | 72.5* | — |
| | Ann+Age | (Edge) | " | 132.5 | 179.5 | 27* | 52.5* | — |
| | " | (Edge) | 1200 | 115.5 | 141.5 | 29.5 | 58* | — |
| 2 | Ann+Age | — | RT | 139.5 | 191 | 24 | 46.5 | — |
| | " | — | 1200 | 126 | 145 | 25.5 | 51 | — |
| | Ann+Age+ | 1000hrs. at 1200° F./A.C. | RT | — | — | — | — | 42.5 |
| 3 | Ann+Age | — | RT | 140 | 194 | 21 | 40 | 29 |
| | " | — | 1200 | 124.5 | 145 | 26.5 | 58.5 | — |
| | Ann+Age+ | 1000hrs. at 1200° F./A.C. | RT | 149 | 189 | 18 | 31 | 17 |
| | " | 5000hrs. at 1200° F./A.C. | RT | 140.5 | 183.5 | 16 | 28 | 11 |
| | " | 1000hrs. at 1300° F./A.C. | RT | 117 | 166 | 16 | 26 | 12 |

(S-2 of 3)

| Alloy No. | Heat Treatment | Exposure Time | Test Temp. ° F. | YS ksi | UTS ksi | El % | RA % | CVN Ft-lbs. |
|---|---|---|---|---|---|---|---|---|
| 4 | Ann | — | RT | 38.5 | 97 | 50* | 72* | — |
| | Ann+Age | — | " | 136 | 186.5 | 23* | 45* | 31 |
| | " | — | 1200 | 111.5 | 139 | 27* | 53.5* | — |
| | " | — | −320 | 160.5 | 237.0 | 25 | 25 | 25 |
| | " | — | −320 | — | 295.5 | Notch Tensile, $K_t$= 3.5 | | |
| | Ann+Age+ | 1000hrs.at 1000° F./A.C. | RT | — | — | — | — | 25 |
| | " | 5000hrs.at 1000° F./A.C. | " | — | — | — | — | 23 |
| | " | 12000hrs.at 1000° F./A.C. | " | — | — | — | — | 24 |
| | " | 1000hrs.at 1200° F./A.C. | RT | — | — | — | — | 21 |
| | " | 5000hrs.at 1200° F./A.C. | " | — | — | — | — | 14 |
| | " | 12000hrs.at 1200° F./A.C. | " | — | — | — | — | 11 |
| 4-T | Ann | (Center) | RT | 38.7 | 84.4 | 43* | 59* | — |
| | Ann+Age | (Edge) | " | 131 | 173.5 | 21* | 30.5* | — |
| | " | (Edge) | 1200 | 106.5 | 130.5 | 20* | 28 | — |
| 5 | Ann+Age−1 | | RT | 132 | 194 | 18 | 37 | — |
| | " | | 1200 | 118.5 | 144 | 22 | 39 | — |
| | "+ | 1000hrs. at 1200° F./A.C. | RT | 146 | 192.5 | 18 | 29.5 | — |
| 6 | Ann | | RT | 43.2 | 108 | 39 | 64.5 | — |
| | Ann+Age | | " | 135 | 193 | 20 | 38.5 | — |
| | " | | 1200 | 125.5 | 144 | 25 | 49 | — |
| | Ann+IT+Age−1 | | RT | 132 | 181 | 14 | 28.5 | — |
| | " | | 1200 | 118.5 | 133 | 19 | 46 | — |
| | Ann+Age+ | 1000hrs.at 1200° F./A.C. | RT | 142.5 | 187.5 | 17.5 | 32 | 14 |

(S-3 of 3)

| Alloy No. | Heat Treatment | Exposure Time | Test Temp. °F. | YS ksi | UTS ksi | El % | RA % | CVN Ft - lbs. |
|---|---|---|---|---|---|---|---|---|
| 7 | Ann | RT | 39.7 | 95.7 | 46 | 69 | — | |
| | Ann+Age | — | " | 122.5 | 170.0 | 22 | 46 | — |
| | " | — | 1200 | 107.5 | 127 | 29 | 59.5 | — |
| | Ann+Age+ | 1000hrs.at 1200° F./A.C. | RT | 118.0 | 162.5 | 21.5 | 40.5 | — |

TABLE II-continued

| | | | | | | | |
|---|---|---|---|---|---|---|---|
| Ann−2 | — | RT | 32.2 | 92.4 | 51 | 68 | — |
| Ann+Age−1 | — | RT | 121.5 | 166.5 | 20 | 9.5 | — |
| " | — | RT | — | 171 | 22 | 44.5 | — |
| " | — | 1200 | 102 | 128 | 30 | 54 | — |

Specimens taken longitudinally from 9/16"-⅝" square bar forgings, except Nos. 1-T and 4-T.
T = Specimens taken transversely from 2½" square bar forgings, "Ann" at center and "Age" at edge of forging cross-sections
Ann = Annealed at 1800° F. for 0.5 hour and Air Cooled
Ann−2 = Annealed at 1950° F. for one hour and Air Cooled
Age = Heat Treated at 1350° F. for 8 hrs. followed by Furnace Cooling at rate of 100° F. per hour to 1150° F. and then held at 1150° F. for 8 hours and Air Cooled (1350° F./8hr., Fc, 1150° F./8 hr)
Age−1 = Age started at 1325° F., then proceeded as above
IT = Intermediate Treatment at 1550° F. for 3 hrs. and Air Cool, between Anneal and Age
RT = Room Temperature
El = % elongation, gage length 1.25-inch for RT and −320° F., 1.0-inch for 1200° F., except*
RA = % reduction in area on 0.252-inch dia. gage section, except*
CVN = Charpy V-Notch impact energy result, foot-pounds
*0.715-inch gage length, 0.178-inch gage diameter

TABLE III

| Alloy No. | Heat Treatment | Stress-Rupture (combination bar) Temp. °F. | Stress ksi | Life Hrs. | El % | RA % |
|---|---|---|---|---|---|---|
| 1 | Ann+Age | 1100 | 120 | 338.4 | 4 | 5 |
| | " | 1200 | 100 | 84.3 | 24 | 30.5 |
| | " | 1300 | 70 | 72.3 | 13 | 23 |
| 2 | Ann+Age | 1200 | 100 | 29.6 | 5 | 11.5 |
| 3 | Ann+Age | 1100 | 125 | 11 | 23.5 | 32.5 |
| | " | 1200 | 90 | 84.5 | 11.5 | 18 |
| | " | 1200 | 100 | 33 | 13 | 25.5 |
| | " | 1300 | 75 | 25.5 | 15 | 20.5 |
| 4 | Ann+Age | 1100 | 120 | 44 | 9 | 19 |
| | " | 1200 | 100 | 14.6 | 31 | 37 |
| | " | 1300 | 70 | 17.9 | 24 | 36 |
| | Ann−1+Age−1 | 1100 | 120 | 37.7 | 6.5 | 5 |
| | " | 1200 | 100 | 58.3 | 8 | 12 |
| | " | 1300 | 70 | 62.6 | 20 | 46.5 |
| 5 | Ann+Age−1 | 1200 | 100 | 27.1 | 13.5 | 17 |
| 6 | Ann+Age | 1200 | 100 | 42.6 | 5.5 | 5 |
| | Ann+IT+age−1 | 1200 | 100 | 26.9 | 10 | 16 |
| 7 | Ann+Age | 1200 | 100 | 3.1 | 15.5 | 19 |
| | " | 1200 | 80, 85,90 | 63.8 | 19 | 31.5 |
| | Ann−2+Age−1 | 1200 | 100 | 3.4 | 27.5 | 39 |

Combination notch/smooth bar specimens taken from 9/16"-⅝" square forgings, $K_t$ = 3.6, smooth gage length = 0.712", gage diameter = 0.178"
Ann−1 = Annealed at 1900° F. for 0.5 hour and Air Cooled
*Accelerated Loading - 80 ksi for 48 hrs., increased to 85 ksi for 8-12 hours, then increased to final stress of 90 ksi Especially good characteristics of at least 130 ksi yield strength at room temperature and 110 ksi yield strength at 1200° F., and 23 hour-1200° F. stress-rupture strengths of 90 ksi and more, often 100 ksi, and satisfactory ductility, were obtained from compositions wherein nickel and titanium were in ranges of about 31% to 34% nickel, 2% to 2½% titanium and relationships A and B were at least 2.6% and 3.3%, respectively.

Age hardening response of the alloy is relatively slow, or sluggish, and thus conducive to good weldability and avoiding strain-age cracking, in contrast to other alloys hardened mainly with large amounts of titanium and aluminum. Also, for good weldability, it is suggested that boron be restricted to not exceed 0.010%, e.g., about 0.005% boron.

Machining experience in the age-hardened condition was very good for a turbine alloy. For instance, in tests of suitability for machining at various speeds, lathe machining with carbide tools at surface speeds of about 150 to 180 feet per minute, with cut depth of 0.05-inch and feed of 0.00825-inch per revolution, was satisfactory for having 12-minute tool life to 0.0015-inch wear during machining embodiments wherein columbium contents were 2.2% and 1.5%. For high speed machining, the lower portion of the columbium, e.g., 1% to 1.75% columbium, can be desirable.

The present invention is particularly applicable for economical production of turbine components requiring high strength and good ductility during exposure to temperatures in the operational area around 1200° F., e.g., compressor blades or seal rings, in automotive, land-based or aerospace turbines. Moreover, the alloy can be useful for bolting, electrical generator retainer rings, and other articles including a compressor casing material.

Although the present invention has been described in conjunction with preferred embodiments, it is to be understood that modifications and variations may be resorted to without departing from the spirit and scope of the invention, as those skilled in the art will readily understand. Such modifications and variations are considered to be within the purview and scope of the invention and appended claims.

We claim:

1. An iron-base alloy adapted for high temperature use and characterized in the wrought and heat treated condition by a 0.02% off-set, yield strength of at least about 100,000 psi at room temperature and high ductility coupled with good stability for long periods of time, said alloy consisting essentially of 29% to 34% nickel, 10% to 14% chromium, 1.5% to 2.5% titanium, 0.95% to 4.3% metal from the group columbium, tantalum and mixtures thereof provided the total of columbium plus one-half the percentages of tantalum is 0.95% to 2.15% and further provided the composition conforms to the relationship A whereby (A) $\%Ti+\frac{1}{3}[\%Cb+\frac{1}{2}(\%Ta)]$ is at least 2%, 0.002% to 0.015% boron, up to 2% manganese, up to 0.5% silicon, up to 0.8% aluminum, up to 0.1% carbon, up to not more than 0.5% each of molybdenum and tungsten in order to minimize adversely affecting stability, and the balance iron in an amount equal to at least 45% of the alloy.

2. An alloy as set forth in claim 1 wherein relationship A equals at least 2.5% and in which the alloy contains at least 1.8% titanium and 0.95% to 2.15% columbium.

3. An alloy as set forth in claim 1 containing at least 1.25% columbium and in which aluminum is present from 0.02% to 0.4%, the boron content is not more than 0.01% and in which the total amount of metal from the group consisting of molybdenum and tungsten, if any, does not exceed 0.6%.

4. An alloy as set forth in claim 1 containing not more than 0.6% in total of metal from the group molybdenum, tungsten and mixtures thereof.

5. An alloy as set forth in claim 1 wherein the composition is further controlled to conform to the relationship B whereby (B) %Ti+%Cb+½%Ta is not greater than 4.4%.

6. An alloy as set forth in claim 1 containing at least 31% nickel and at least 2% titanium and wherein relationships A and B are at least 2.6% and 3.3% respectively.

7. A fine-grain wrought product as set forth in claim 1 in the fine grain condition characterized by a grain size of ASTM 6.5 or finer.

8. A coarse-grain product as set forth in claim 1 in the coarse grain condition characterized by a grain size of ASTM 5.5 or larger.

* * * * *